US006543081B1

(12) United States Patent
Cohen

(10) Patent No.: US 6,543,081 B1
(45) Date of Patent: Apr. 8, 2003

(54) FLIP-UP WRINGER SPONGE MOP

(76) Inventor: Sheldon C. Cohen, 413 Larkspur St., Philadelphia, PA (US) 19116

( * ) Notice: Subject to any disclaimer, the term of this patent is extended or adjusted under 35 U.S.C. 154(b) by 168 days.

(21) Appl. No.: 09/638,620

(22) Filed: Aug. 15, 2000

(51) Int. Cl.[7] ..... A47L 13/144
(52) U.S. Cl. ..... 15/119.2
(58) Field of Search ..... 15/116.2, 119.2, 15/119.1

(56) References Cited

U.S. PATENT DOCUMENTS 2,740,146 A * 4/1956 Vaughn
4,439,885 A 4/1984 Klotz
4,777,690 A 10/1988 Ancier
5,530,982 A 7/1996 Specht
5,655,248 A 8/1997 Kieson
6,216,307 B1 * 4/2001 Kaleta

* cited by examiner

*Primary Examiner*—Randall E. Chin
(74) *Attorney, Agent, or Firm*—Paul Maleson

(57) ABSTRACT

A flip-up-wringer sponge mop a wringer system in which the expelling of dirty water from the mop is effective in minimizing unwanted recycling of the water back into the sponge. The mop has a mop head comprising a generally planar mop sponge backed by a head plate. It has roller means to move against the sponge and squeeze out water. It has means to allow the handle to pivot with respect to the head so that the mop head can flip back over the handle or the handle can have its angle to the head reduced so as to permit the mop head to reach under low furniture and the like.

9 Claims, 9 Drawing Sheets

FLIP-UP WRINGER SPONGE MOP

TECHNICAL FIELD

This invention relates to floor mops and more particularly to mops having sponge-type mopping surfaces. More particularly, it relates to wringer systems, means or mechanisms and methods for cleanly wringing out the sponge, and to provide other advantages. A flip-up-wringer sponge mop is provided.

The invention provides a wringer system in which the expelling of dirty water from the mop is efficient and effective in minimizing the unwanted recycling of the water back into the sponge, and also permits operation of the mop under low furniture.

BACKGROUND ART

There are a substantial number of expedients disclosed in the patent literature. Several of these, considered most pertinent and representative are listed on a 37 CFR 1.97 Information Disclosure Statement, together with copies thereof. These are Specht U.S. Pat. No. 5,438,727; Kieson U.S. Pat. No. 5,655,248; Ancier U.S. Pat. No. 4,777,690; and Klotz U.S. Pat. No. 4,439,885.

A pertinent patent is Specht, U.S. Pat. No. 5,438,727. It has a flat sponge head. It has a wringing roller that is normally positioned at a long edge of the mop head and is raised out of the way during the mopping operation. The roller is actuated by the user to run across the mop head and wring out the water. A significant difference is that Specht's mop head does not pivot or flip up. In the present invention, by flipping up, a straight pull back on the lever can run the roller. In Specht's case, because there is a fixed angle between the mop head and the handle, a cranking mechanism or lever is needed. Specht's system is more cumbersome to operate and more expensive to build. Also, it does not have the advantage of having a pivot so that the mop can get under low furniture and the like.

The following patents are pertinent only in that they do involve sponge heads and rollers. The Klotz patent U.S. Pat. No. 4,439,885 provides a system for running a roller directly over the surface of a mop head. The mop head is curved rather than flat, and Klotz's operating system is clumsy to operate.

The patents to Ancier U.S. Pat. No. 4,777,690 and Kieson U.S. Pat. No. 5,655,248 are of less pertinence. They do show a direct wringing action of rollers against mop heads. However, they both have the concept of squeezing the mop head from its edges, so that it is squeezed together against itself. This is different from the more common folding-squeezing types of mop heads it is not as efficient in its wringing operation as the present invention. There are many other patents in the field, but are believed to be of only cumulative interest.

SUMMARY OF THE INVENTION

An object of this invention is to provide a flip-up-wringer sponge mop.

It is another object of this invention to provide a wringer system in which the expelling of dirty water from the mop is efficient and effective in minimizing the unwanted recycling of the water back into the sponge.

The mop has a mop head comprising a generally rectangular, generally planar mop sponge backed by a head plate. It has roller means to move against the sponge and squeeze out water. It has means to allow the handle to pivot with respect to the head so that the mop head can flip back over the handle or the handle can have its angle to the head reduced so as to permit the mop head to reach under low furniture and the like.

The mop has a full width squeezing roller bearing against the mopping surface distal from the back plate. It has roller guides, which are really wheels, running on the back plate.

A reason why the upper guides are necessary (in addition to providing stability in spacing for the system), is that as the rollers are pulled to the end of their wringing operation, the upper guides run up a ramp or hump and in doing so they raise the wringing roller away from the mopping surface. Thus, the wringer is out of the way when actual mopping takes place.

In order to start the wringing action, the mop head has to be flipped completely over so that when the operator pulls back on the wringing handle, the wringing roller moves upward. That is, it moves from its normal position which is at the rear of the mop head, to the front of the mop head. During the wringing action, the front of the mop head is nearest the operator.

An advantage of the present invention is that by its having a high degree of hinged mobility between the handle and the mop head, the handle can be lowered close to the floor so that the mop head can get under low furniture.

Another advantage of the present invention is that whereas prior art devices tend to squeeze dirty water out of the mop by pressing sections of the mopping material together, thus entrapping the dirt into the mopping material, the present invention flushes away the dirt.

Another advantage of the present invention is that depending on how far back the operator pulls, the amount of water wrung out of the pad is graduated. Thus, the mop can be returned to use after wringing in the desired degree of wetness.

Another advantage of the present invention is that the inherent structure of the wringing system keeps the wringing roller out of the way during the mopping operation.

Other advantages will appear in the detailed description.

DESCRIPTION OF THE PREFERRED EMBODIMENTS

Figure 1:
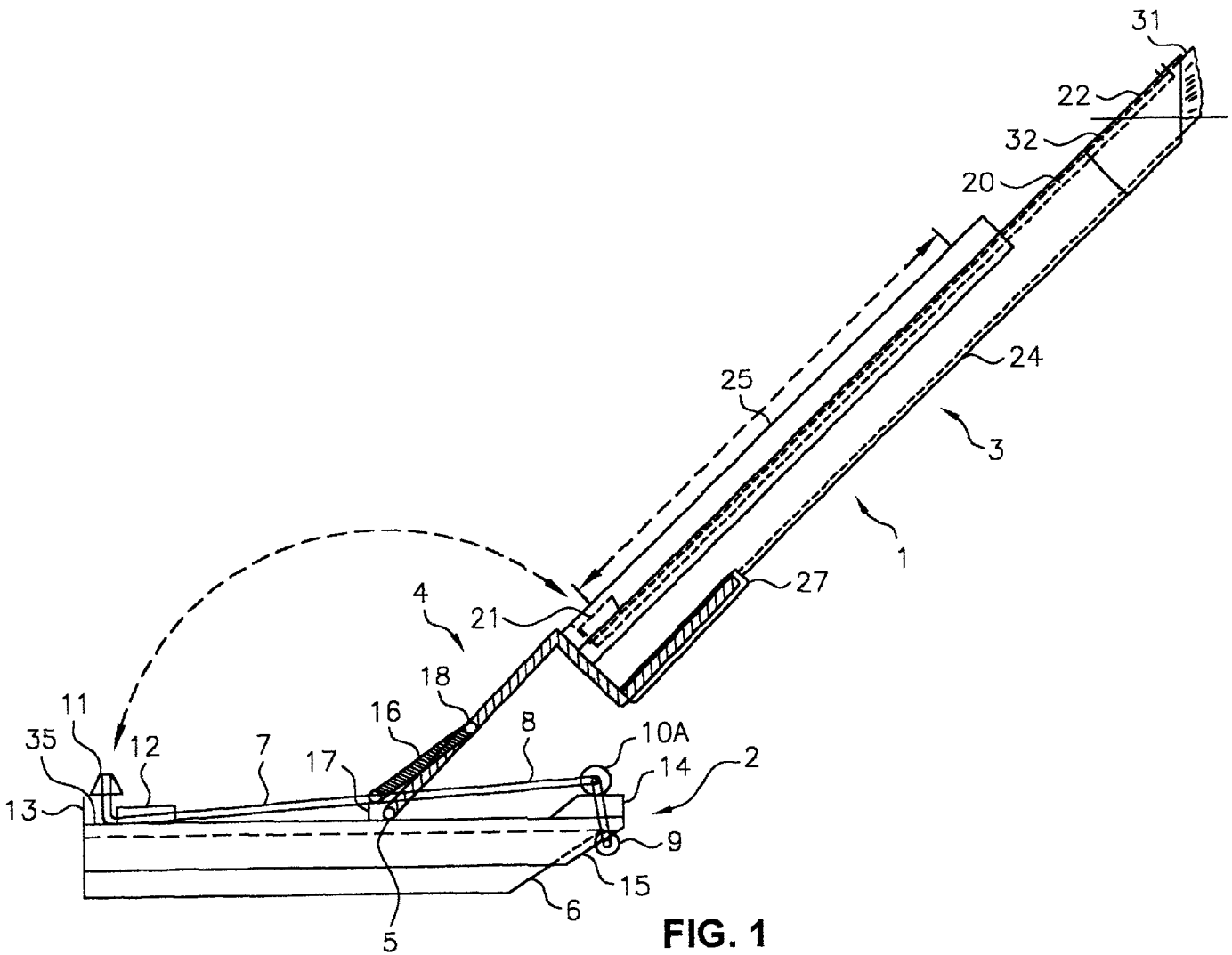
FIG. 1 is a side elevation view of the flip-up wringer sponge mop, partially fragmented and partially in longitudinal cross-section.

In the most general sense and preferred and usual embodiment, the flip-up wringer sponge mop of this invention is a flat faced sponge type mop with a handle that permits changing its angle with respect to the face of the mop from substantially a straight line extension thereof to a position wherein the mop head is rotated so as to be folded back against the handle. That is, the mop head may pivot substantially 180 degrees. An important aspect is that the operator may flip the mop head to its folded back position by a pull on a handle, and may then run a wringing roller across the entire face of the mop. The sponge mop is squeezed against a rigid mop head plate. The roller may be moved back and forth. In an alternate embodiment, the flip up and wringing motions may be done by a battery powered motor. The sponge mop may be replaced with other attachments for other purposes.

A number of advantages stem from the structure of this invention, and some are here given briefly in no particular order of importance. The vertically pivoting nature of the mop head allows the sponge mop to stay in flat contact with the floor at all times. Less effort in cleaning is required than with other mops. A tall or short operator can use the mop with the same effort. No special action has to be taken to keep the entire mop surface in full contact with the floor. The same forward motion that propels the mop across a floor can move it under low-lying furniture, as beds, dressers and the like, without any special adjusting action being taken by the operator. A longer reach is also a product of the freely vertically pivoting head. Also, the mop can be used on walls as well as floors. The mop head rotates from a mopping position to a wringing position and the wringing takes place with a simple single hand motion.

The aspect of the invention that permits the mop sponge to be squeezed and wrung against the head plate produces important advantages. Because the sponge is not squeezed against itself, the wringing action does not trap or recirculate the dirt. The wringing takes place without wetting the hands. The operator does not have to bend over to perform the wringing action. The sponge mop wringer roller can be moved in one direction to squeeze out the dirty water and then moved in the other direction while submerged to further flush out the sponge. Alternatively, the roller being run up and back across the face of the sponge provides a more through expelling of the dirty water. The operator's controlled motion of the roller permits the mop to be used in fully wet condition or in chosen various degrees of partial wetting, or as a dry mop.

The structure of the device gives a manufacturer easier leeway in varying the size of the mop sponge. A typical size of the mop sponge may be about 9" by 11", all of which can contact the surface to be cleaned, and which is a larger contact than other known sponge mops. The structure also lends itself to being motorized, as more fully described below. In this embodiment, a rechargeable battery powers a motor in the mop handle. A switch in the handle controls the motor.

The general structure and operation are perhaps best initially understood in connection with FIG. 1. The flip-up wringer sponge mop generally designated 1 has a mop handle 3 and a mop head 2. These parts are connected by mop connector 4, as also shown for example in FIGS. 2, 3, 6, 7, and 8. The mop sponge 6 is carried in the mop head 2. The mop connector 4 pivots vertically with respect to the mop head 2 within the identical right and left connector sockets 5.

Figure 17:
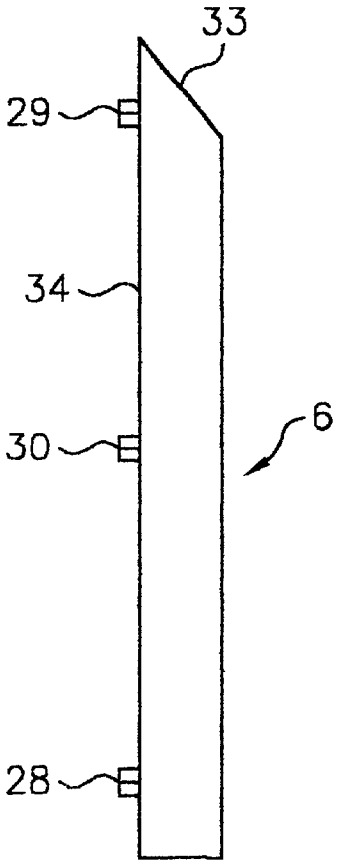
FIG. 17 is a side view of the mop sponge.
Figure 16:
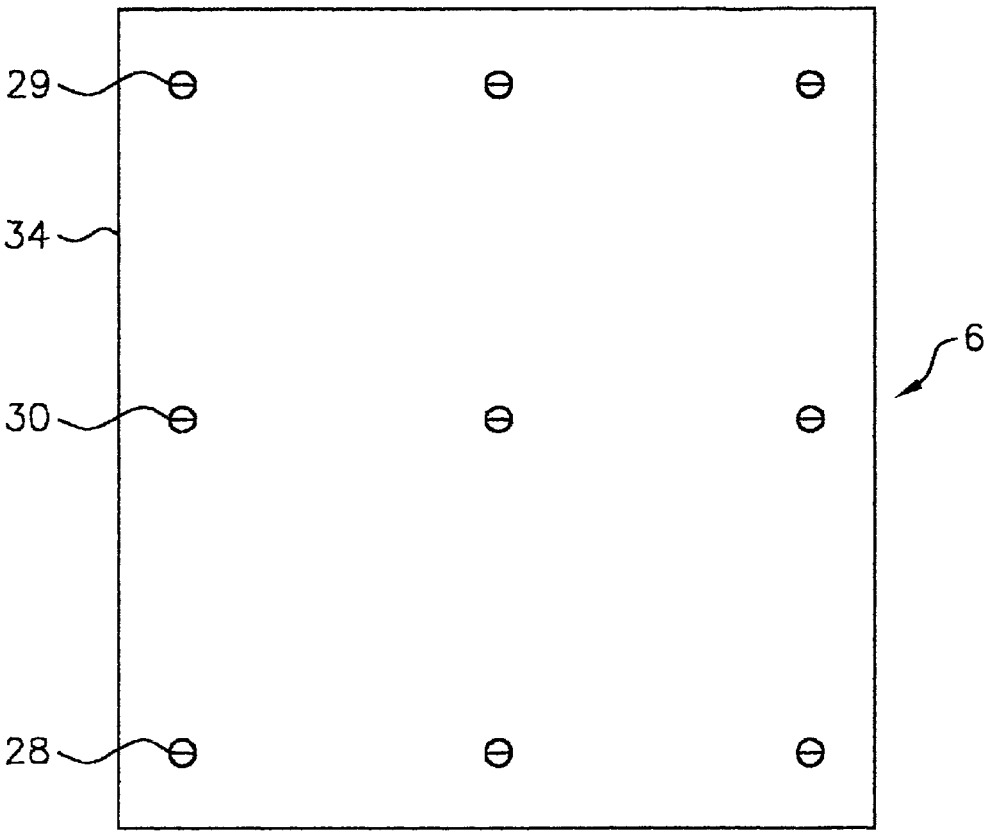
FIG. 16 is a plan view of the mop sponge.
Figure 18:
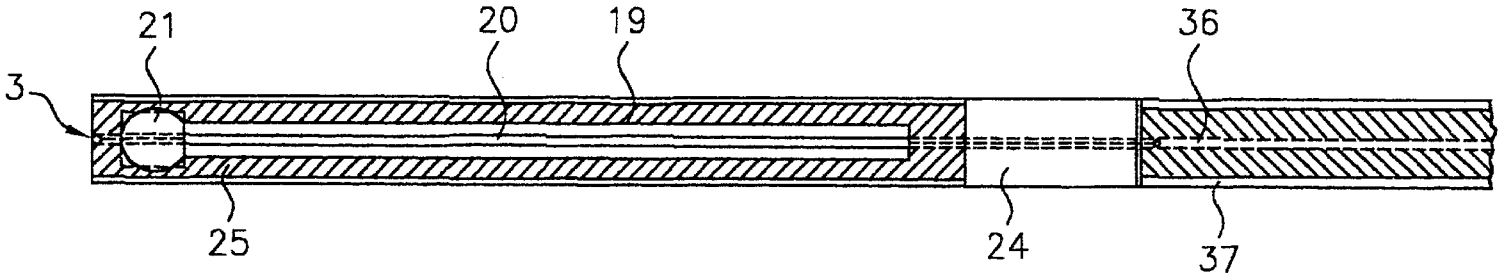
FIG. 18 is a top proximal portion view, partially in longitudinal cross-section, partially fragmented, of a motorized embodiment of the flip-up wringer sponge mop.
Figure 19:
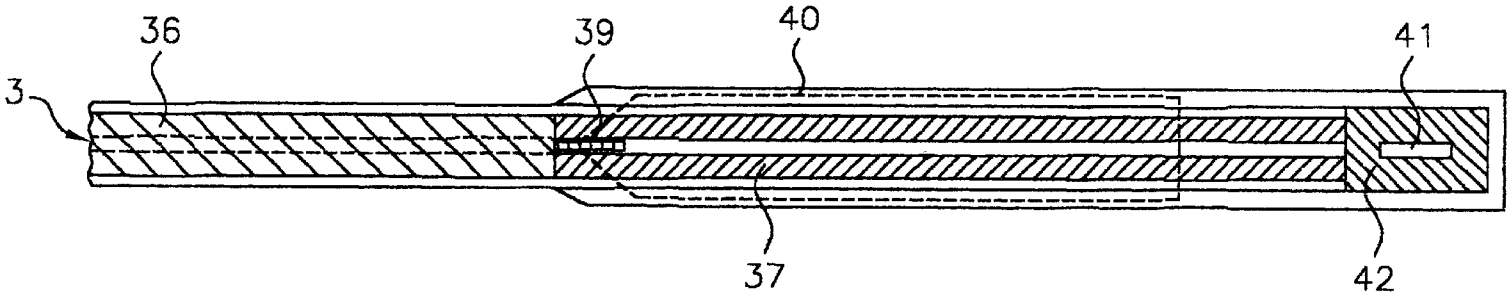
FIG. 19 is a top middle portion view, partially in longitudinal cross-section, partially fragmented, of a motorized embodiment of the flip-up wringer sponge mop.
Figure 20:
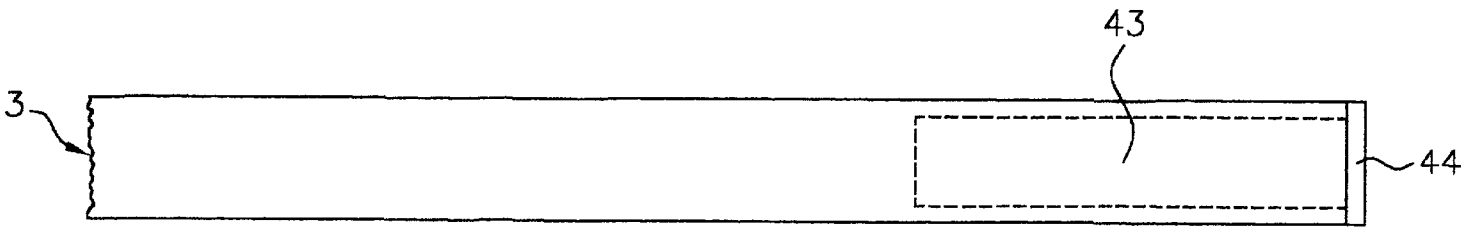
FIG. 20 is a top distal portion view, and showing a rechargeable battery in phantom, partially in longitudinal cross-section, partially fragmented, of a motorized embodiment of the flip-up wringer sponge mop.
Figure 21:
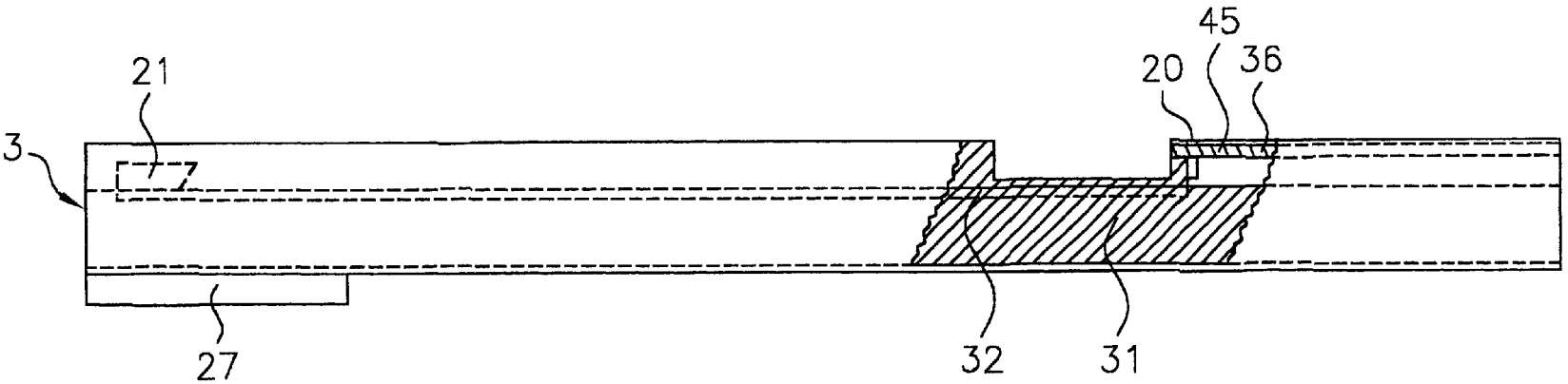
FIG. 21 is a side proximal portion view, partially in longitudinal cross-section, partially fragmented, of a motorized embodiment of the flip-up wringer sponge mop.
Figure 22:
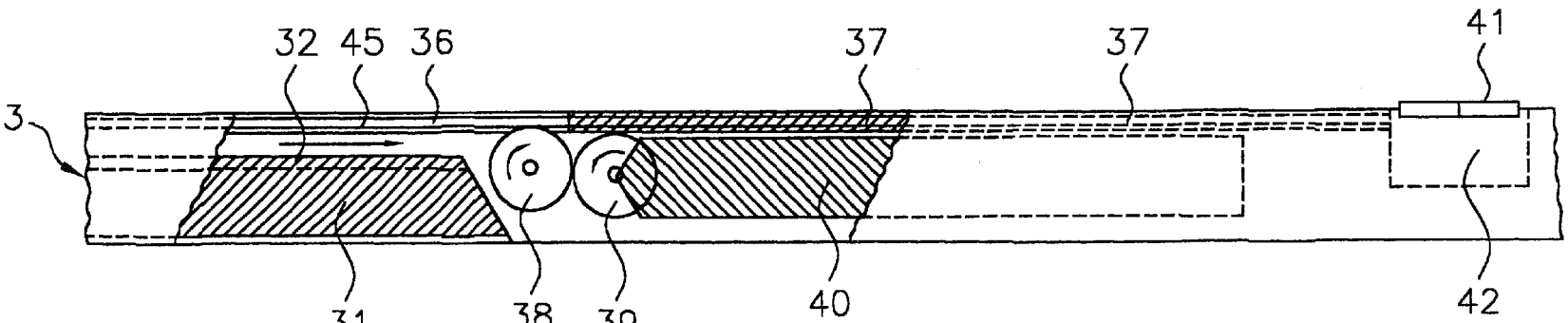
FIG. 22 is a side middle portion view, partially in longitudinal cross-section, partially fragmented, of a motorized embodiment of the flip-up wringer sponge mop.

The mop sponge 6 is shown in more detail in FIGS. 16 and 17. It has a conventional sponge backing 34 which is generally a fabric. It is provided with sets of three each rear sponge clip-in 29, center sponge clip-ins 30 and front sponge clip-ins 28. As best shown in FIG. 17, it is preferably provided with a beveled sponge plastic tip 33, the clip-in permit the mop sponge 6 to be fastened to the mop head plate 35, when worn out, the mop sponge 6 may be removed from the head plate 35 and replaced.

Figure 2:
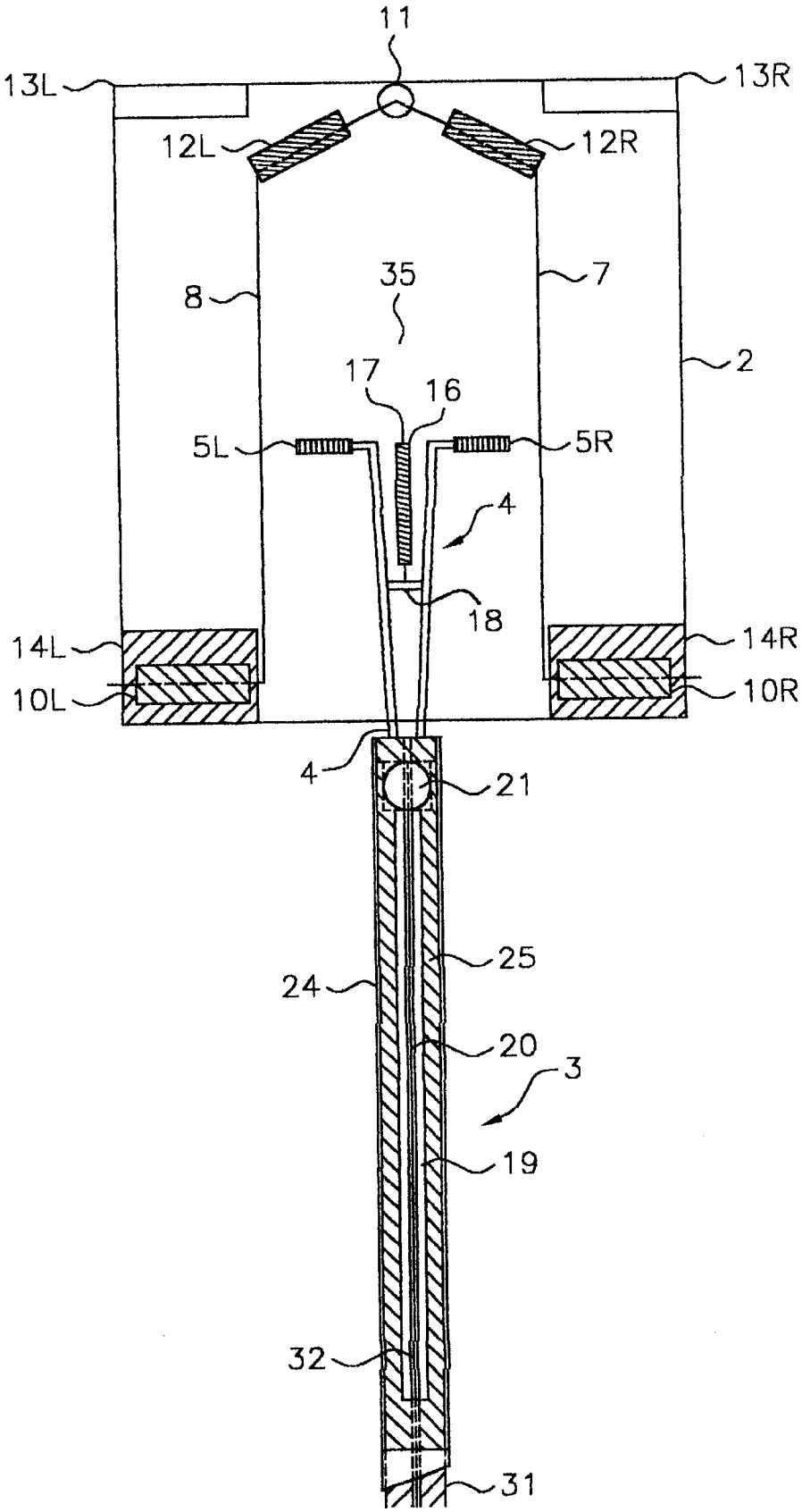
FIG. 2 is a top view of the flip-up wringer sponge mop, partially fragmented, in the mopping position.

The surface of the head plate 35 opposite to the side holding the mop sponge 6 is herein referred to as the top of the plate. The top of head plate 35 is provided with a pair of identical right and left wringer clasps 12. As best shown in FIG. 2, these wringer clasps are positioned near one end of the head plate 35. About in the middle or slightly below the middle of head plate 35 are provided a pair of identical right and left connector sockets 5, as described. Substantially centered between the two connector sockets 5 is a spring catch 17.

At the other end of the head plate 35, on the top, as best shown in FIG. 2, are a pair of identical right and left wedge roller keepers 14. These roller keepers may also be called humps or spacers to raise identical right and left roller guides 10 and so raise the wringer roller 9 up the beveled tip 33 so as to keep the wringer roller out of the way while the mopping operation is proceeding.

The general structure of the mop wringer, generally designated 7, is perhaps best shown in FIGS. 13, 14 and 16, 17 and 18. A metal rod is shaped into an extended more or less rectangular wringer frame 8. This wringer frame runs through the center, as an axle, of a sponge wringer roller 9. The frame, at one end, is bent upward out of a planar shape and fits freely around the side edges of the rigid mop head plate 35. As perhaps best shown in the end view of FIG. 13, the wringer frame 8 continues across the top of the head plate 35 and passes through the centers, as an axle, of the two identical right and left roller guides 10.

Figure 13:
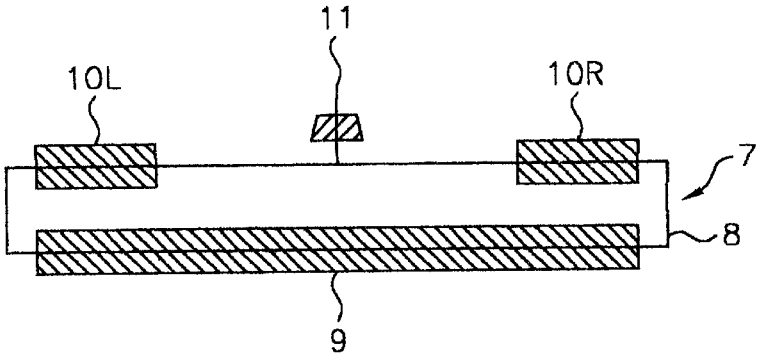
FIG. 13 is a schematic front view of the mop wringer.
Figure 14:
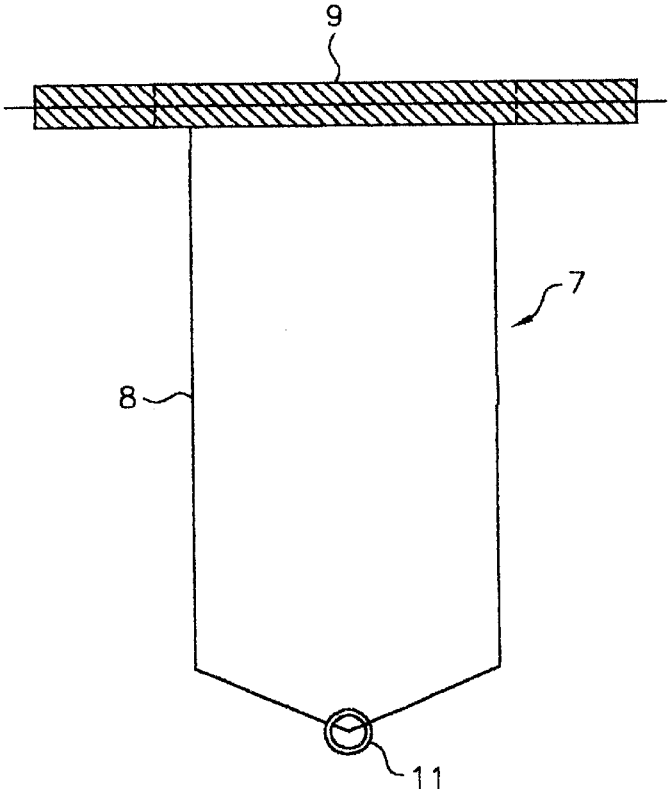
FIG. 14 is a schematic top view of the mop wringer.

Thus, the pairs of wringer clasps 12, the pairs of connector sockets 5 and the pairs of wedge roller keepers 14 are all securely fastened on the top surface of the head plate 35. Their general positional relationship is best shown in FIG. 2. As shown in FIG. 13, the wringer roller 9 extends across the face of the mop sponge 2, and the two roller guides 10 on the top of head plate 35 are shorter than the wringer roller 9. The roller guides 10 may be moved along the top surface of the head plate 35 in conjunction with the corresponding movement of the wringer roller 9 along the mopping surface of the mop sponge 2. When the system is in the mopping mode or condition, the roller guides 10 are on top of the roller keepers 10, as best shown in FIGS. 1 and 2, and thus the wringer roller 9 is on the beveled part of the mop sponge 6 and is hence withdrawn from the mopping face or surface and is out of the way. It thus does not interfere with the mopping action.

The two arms of the extended wringer frame 8, after passing through the wringer clamps 12, meet at the center of the head plate 35 near one end thereof at the wringer connector tip 11.

Figure 6:
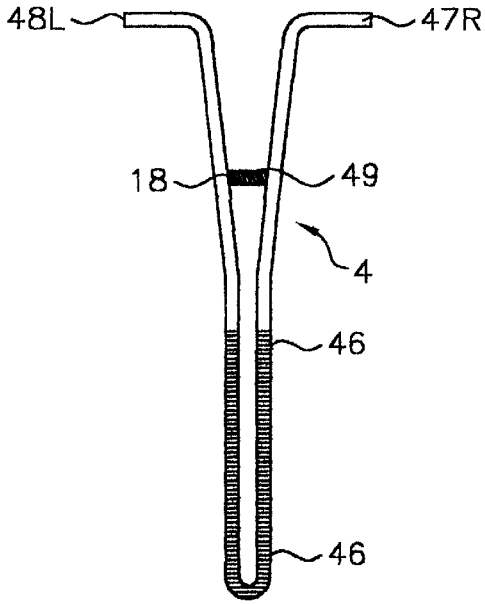
FIG. 6 is a top view of the mop connector.

An extended metal rod is shaped into a mop connector 4, as perhaps best shown in FIGS. 1,2 6, 7, and 8. The connector 4 is generally Y-shaped, as shown in FIG. 6. The lower straight portion of the Y is the handle connector arm 46. It then flares outward, an approximate midpoint of the flare is joined with a spring cross bar 18. The spring cross bar 18 has a spring hole 49. At the end of the flare, each arm of the mop connector 4 is bent outwardly so that the directions of the two bent portions directly oppose each other in outwardly directions. These bent portions of the connector 4 are a pair of identical right and left mop connector arms 47.

Figure 7:
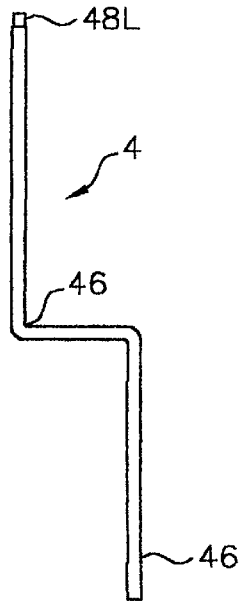
FIG. 7 is a side view of the mop connector.
Figure 8:
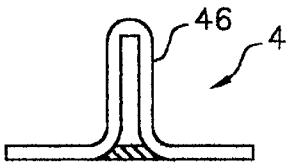
FIG. 8 is an end view of the mop connector.

As perhaps best shown in FIGS. 7 and 8, the handle connector arms 46 are bent downward from the plane of the flare into two successive 90 degree turns. In the mopping condition, the step shape formed by the 90 degree turns fits around the end of the mop head plate most remote from the wringer connector tip 11.

The mop connector 4 connects the mop head 2 to the mop handle 3. The two mop connector arms 47 hook into their respective mop connector sockets 5. The handle connecting arms 46 fits into a mop connector slot 27 on mop handle 3. This serves to connect mop head 2 to mop handle 3.

A helical coiled spring 16 is provided. It is fastened at one end to the spring hole 49 in spring cross bar 18. The other end is fastened to spring catch 17 on top of the mop head 2.

The mop handle 3 comprises a round handle 31, preferably made of wood. This round handle 31 has a longitudinal grooved rod track 32 as shown in FIGS. 4 and 5, the track 32 runs about half the length of the mop handle 3.

Figure 15:
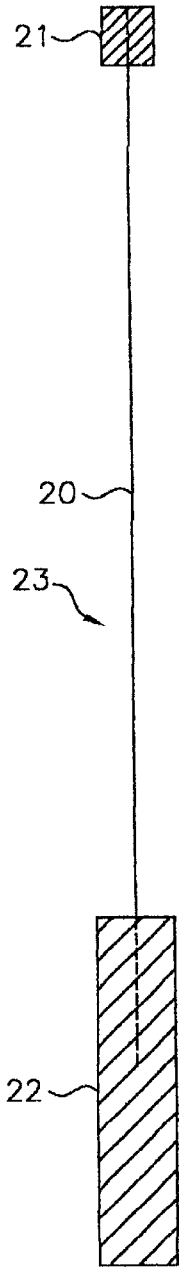
FIG. 15 is a schematic view of the wringer rod assembly.

The wringer rod assembly, shown schematically in FIG. 15, comprises a wringer rod socket 21, an extended straight wringer rod 20, and a wringer rod handle 22. The rod 20 connects the socket 21 to the rod handle 22. The wringer rod assembly 23 is slid into the round wood handle 31. The wringer rod handle 22 is preferably of tubular steel or similar metal. It holds the assembly on the round wood handle 31 with wringer rod 20 in the grooved rod track 32, as shown in FIGS. 4 and 5, and the wringer rod socket 21 attached to the end of wringer rod 20 as shown in FIG. 2.

Figure 3:
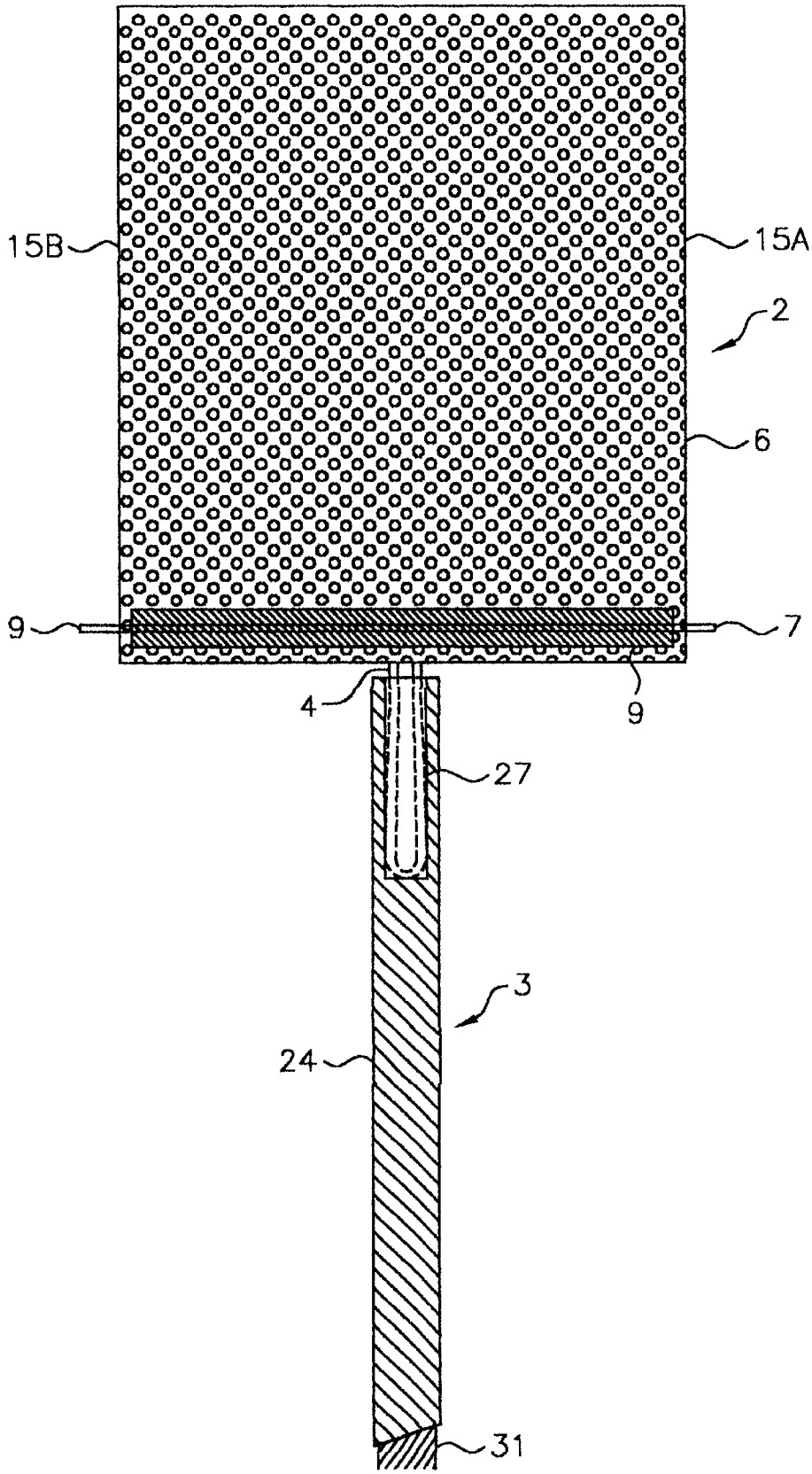
FIG. 3 is a top view of the flip-up wringer sponge mop, partially fragmented, flipped up into the wringing position.

The mop handle jacket 24, also tubular and preferably of steel or similar metal, slides over the top end of the round wood handle 31. It thus becomes a substantial portion of the outer part of mop handle 3, as shown in FIGS. 1 and 5. On the bottom of the mop handle jacket is the mop connector slot as shown in FIGS. 1 and 3.

Figure 4:
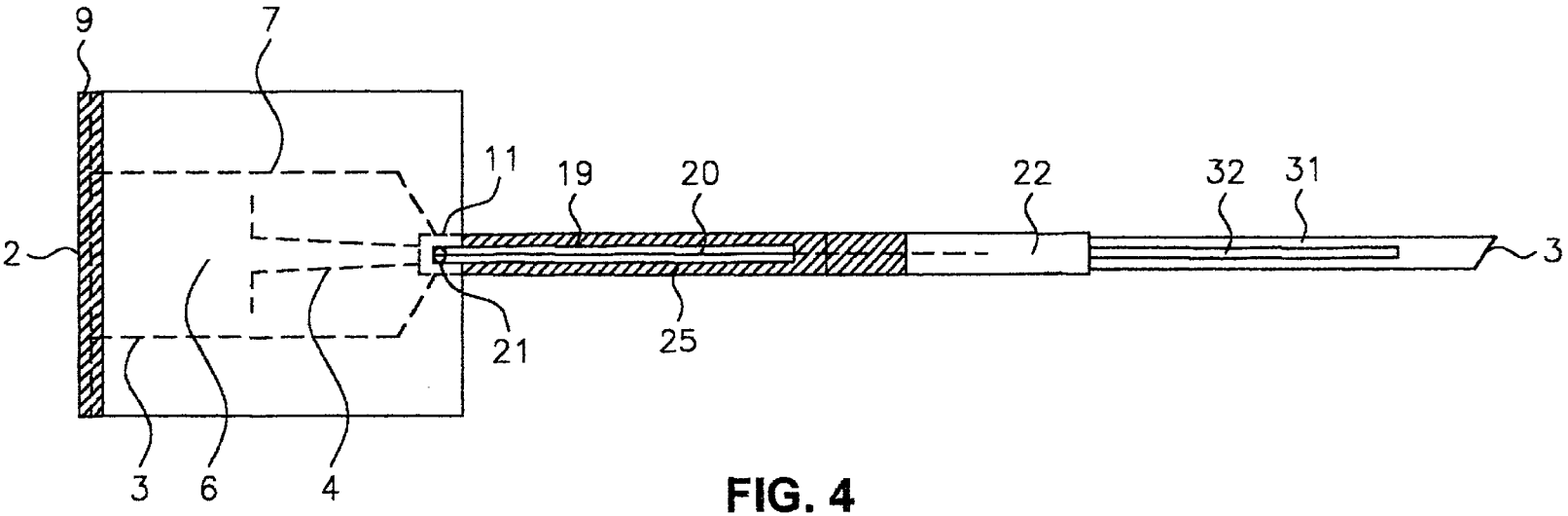
FIG. 4 is a top view of the flip-up wringer sponge mop, partially fragmented, partially in longitudinal section, flipped up into the wringing position, showing the wringer roller ready to be pulled across the mop sponge, with the hidden mop connector shown in phantom.
Figure 5:
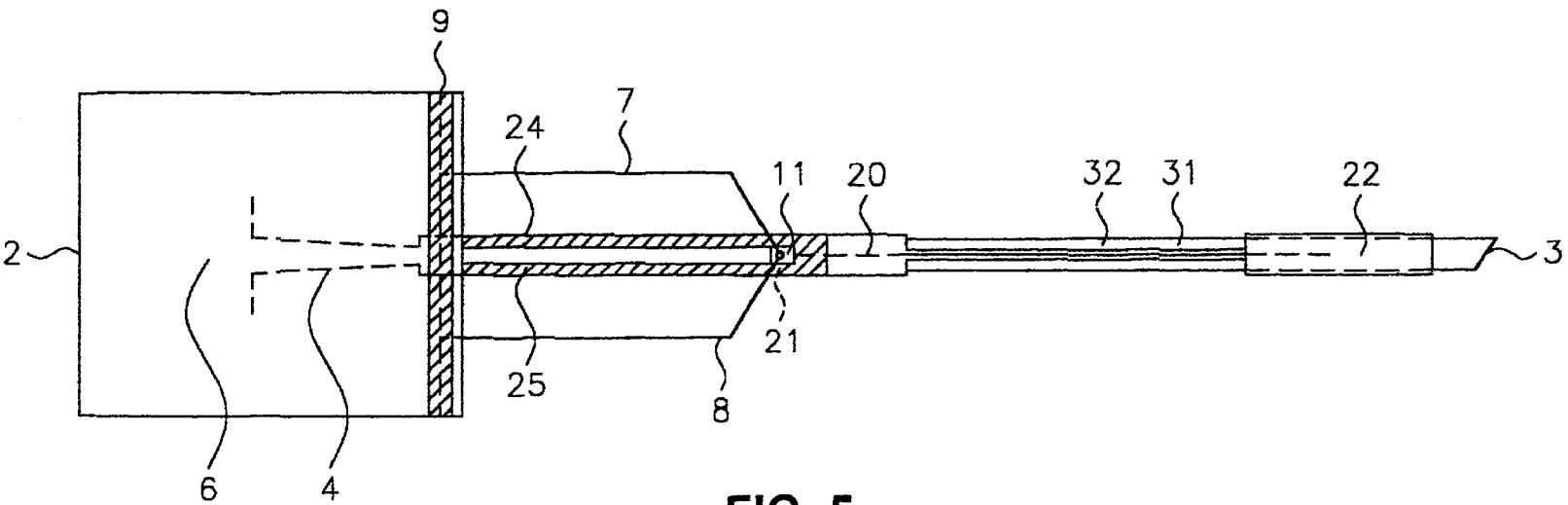
FIG. 5 is a top view of the flip-up wringer sponge mop, partially fragmented, partially in longitudinal section, flipped up into the wringing position, showing the wringer roller pulled back across the mop sponge, with the hidden mop connector shown in phantom.

On top of the mop handle 3 is a wringer rod guide 25 as shown in FIGS. 2 and 4, cut into the top of the guide 25 is a wringer guide slot 19, as shown in FIG. 2. The mop handle jacket 24 also houses part of the wringer rod assembly 23, that is, the wringer rod socket 21 and part of the wringer rod 20. At times during operation of the device, the jacket 24 also houses wringer rod tip 11, as shown in FIG. 5.

As shown in FIG. 4, the wringer rod handle butts up against the mop handle jacket 24 and controls the wringer rod assembly 23. The wringer rod assembly, linked to the wringer connector tip 11 controls the wringing of the mop. In use, the operator moving the wringer rod handle 22 back and forth on the mop handle 3 carries out the wringing action as has been described.

The wringing action of the device can be made motor driven by modifying the mop handle 3. This alternate embodiment is illustrated in FIGS. 18, 19, 20, 21, and 22. The back and forth wringing motion is activated by operation of a two-direction switch 41 mounted on modified mop handle 3. The wringer rod 28 is attached to the notched wringer bar 36. The notched wringer bar 36 has a rack gear 45 molded into the bottom side, a rack gear 45 meshes with a connecting gear 38. The connecting gear meshes in turn with motor gear 39. A motor assembly 40 drives the motor gear 39. A rechargeable battery 43 is provided at the extreme top end of mop handle 3. It is apparent that when the switch 41 is left untouched it remains in a neutral position. Pushing it to either the forward or back position produces a corresponding direction of travel of the wringer roller 9.

Figure 9:
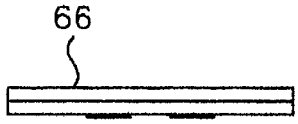
FIG. 9 is a paint applicator to replace the mop head on the mop connector.
Figure 10:
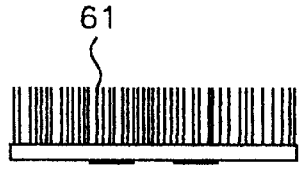
FIG. 10 is a push broom to replace the mop head on the mop connector.
Figure 11:
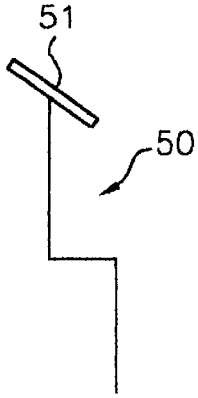
FIG. 11 is a schematic view of a wax head to replace the mop head on the mop connector.
Figure 12:
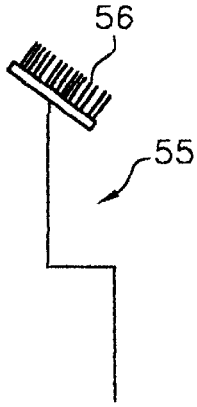
FIG. 12 is a schematic view of a scrub brush to replace the mop head on the mop connector.

The mop head 2 can be disconnected from the mop connector 4 and replaced by other attachments for other purposes. FIG. 9 shows a paint applicator 66 as a replacement attachment, permitting use of the device to paint walls and floors for example. FIG. 10 shows a push broom 61 as a replacement attachment. FIG. 11 shows 11 shows a waxing attachment 50 with a wax head 52, schematically, as a replacement attachment. FIG. 12 shows schematically a scrubbing attachment 55 having a scrub brush 56. Thus, another advantage of the present invention is the ability to change its intended use quickly.

As the wringer rod handle 22 is pulled back, the mop head 2 rotates from the mopping position to the wringing position and the sponge wringer roller 9 leaves the keeper 14 and begins rolling over the mop sponge 6 wringing out water and dirt. The device, in that flipped-up condition and wrung out, can be dipped into cleansing water and then the roller 9 is run back over the mop surface to provide a cleaned but not soaking wet mop, alternatively, the roller can be run back to its retracted mopping condition before the mop head is dipped into cleansing water, in which case the mop is available for use in a sopping wet or soaking wet condition if that is desired. As described above, the operation of the rod handle 22 permits mopping use in any degree of saturation of the mop sponge. As described above, the inherent nature of the device opposes entrapping of dirt in the sponge mop.

I claim:

1. A flip-up wringer sponge mop comprising a mop head and a mop handle, said mop head being vertically freely pivotable with respect to said mop handle of about 180 degrees from a mopping position as an extension of said mop handle to a flipped-up wringing position over said mop handle, said mop head comprising a head plate having top and bottom surfaces, and a mop sponge, said mop sponge affixed to said bottom surface of said head plate and having a substantially planar mopping surface adapted to be in complete contact with a mopped surface, and a mop wringer including a wringer roller sized and configured to roll over the entire surface of said mop sponge, said wringer roller being positioned adjacent said mopping surface and being connected to a roller guide, said roller guide adapted to roll on said top surface of said head plate when said wringer handle is pulled, a wringer rod handle on said mop handle, said wringer rod handle being operatively connected to said mop head and said wringer roller to flip up said mop head and to roll said wringer roller over the entire mopping surface of said mop sponge and squeeze it against said head plate when said wringer rod handle is pulled.

2. A flip-up wringer sponge mop as set forth in claim 1 wherein said top surface of said head plate has a roller keeper, and said roller guide rides on said roller keeper when said wringer handle is not pulled.

3. A flip-up wringer sponge mop as set forth in claim 2 wherein said mop sponge has a beveled extension tapering to a reduced thickness, and said wringer roller is positioned on said beveled extension and is retracted from said mopping surface when said wringer handle is not pulled.

4. A flip-up wringer sponge mop as set forth in claim 3 wherein said mop head is provided with a mop connector socket, and said mop handle is connected to said mop head by said mop connector socket, a mop connector slot on said mop handle, said mop connector being removably affixed in said mop connector slot.

5. A flip-up wringer sponge mop as set forth in claim 4 wherein a helical coiled spring is provided bet ween said mop connector and said head plate.

6. A flip-up wringer sponge mop as set forth in claim 5 wherein said wringer rod handle is adapted to be pulled to any proportion of its maximum length of travel and then be returned to its unpulled condition.

7. A flip-up wringer sponge mop comprising a mop head and a mop handle, said mop head being vertically freely pivotable with respect to said mop handle of about 180 degrees from a mopping position as an extension of said mop handle to a flipped-up wringing position over said mop handle, said mop head comprising a head plate having top and bottom surfaces, and a mop sponge, said mop sponge affixed to said bottom-surface of said head plate and having a substantially planar mopping surface adapted to be in complete contact with a mopped surface, and a mop wringer including a wringer roller sized and configured to roll over the entire surface of said mop sponge, said wringer roller being positioned adjacent said mopping surface and being connected to a roller guide, said roller guide adapted to roll on said top surface of said head plate when said wringer handle is pulled, a wringer rod handle on said mop handle, said wringer rod handle being operatively connected to said mop head and said wringer roller to flip up said mop head and to roll said wringer roller over the entire mopping surface of said mop sponge and squeeze it against said head plate when said wringer rod handle is pulled, an electric motor operatively connected to said wringer rod handle, a two-direction switch to cause sail motor to ooperate to either retract or return said wringer rod handle.

8. A flip-up wringer sponge mop as set forth in claim 7 wherein said top surface of said head plate has a roller keeper, and said roller guide rides on said roller keeper when said wringer handle is not retracted.

9. A flip-up wringer sponge mop as set forth in claim 7 wherein said mop sponge has a beveled extension tapering to a reduced thickness, and said wringer roller is positioned on said beveled extension and is retracted from said mopping surface when said wringer handle is not retracted.

* * * * *